US008029393B2

(12) United States Patent
Frazier

(10) Patent No.: US 8,029,393 B2
(45) Date of Patent: Oct. 4, 2011

(54) FOAM GAME BALL WITH TUBULAR HOLES

(76) Inventor: John K. Frazier, Lafayette, CA (US)

( * ) Notice: Subject to any disclaimer, the term of this patent is extended or adjusted under 35 U.S.C. 154(b) by 0 days.

(21) Appl. No.: 11/683,384

(22) Filed: Mar. 7, 2007

(65) Prior Publication Data

US 2008/0220915 A1 Sep. 11, 2008

(51) Int. Cl.
*A63B 41/00* (2006.01)

(52) U.S. Cl. ..... 473/594; 473/577

(58) Field of Classification Search ..... 473/613, 473/596, 600–602, 570, 571, 597, 577, 595, 473/594

See application file for complete search history.

(56) References Cited

U.S. PATENT DOCUMENTS

| | | | | | |
|---|---|---|---|---|---|
| 1,187,838 | A | * | 6/1916 | Hughes | 473/571 |
| 1,483,165 | A | * | 2/1924 | Eaton | 473/281 |
| 4,002,893 | A | * | 1/1977 | Newcomb et al. | 473/570 |
| 4,133,528 | A | * | 1/1979 | Koblick | 473/570 |
| D264,741 | S | * | 6/1982 | Patton | D21/712 |
| 4,887,814 | A | * | 12/1989 | Winter | 473/596 |
| RE33,449 | E | * | 11/1990 | Martin | 473/613 |
| 5,033,743 | A | * | 7/1991 | Wright | 473/613 |
| 5,080,359 | A | * | 1/1992 | Thill | 473/570 |
| 5,228,687 | A | * | 7/1993 | Luecke et al. | 473/596 |
| 5,253,866 | A | * | 10/1993 | Moorman et al. | 473/571 |
| 5,269,514 | A | * | 12/1993 | Adler et al. | 473/596 |
| 5,277,641 | A | * | 1/1994 | Gable et al. | 473/594 |
| 5,288,069 | A | * | 2/1994 | Matsumoto | 473/570 |
| 5,383,660 | A | * | 1/1995 | Adler et al. | 473/596 |
| 5,458,329 | A | * | 10/1995 | Bushman et al. | 473/613 |
| 5,460,368 | A | * | 10/1995 | Pearson | 473/597 |
| 5,480,143 | A | * | 1/1996 | McMurry | 473/571 |
| 5,496,026 | A | * | 3/1996 | Montgomery | 473/570 |
| 5,611,532 | A | * | 3/1997 | Forrest, Sr. | 473/576 |
| 5,676,611 | A | * | 10/1997 | Foster et al. | 473/613 |
| 5,683,316 | A | * | 11/1997 | Campbell | 473/570 |
| D411,269 | S | * | 6/1999 | Albarelli, Jr. | D21/712 |
| 5,996,503 | A | * | 12/1999 | Woodall et al. | 473/577 |
| D479,897 | S | * | 9/2003 | Willinger | D21/712 |
| 6,908,662 | B2 | * | 6/2005 | Pearce | 473/596 |
| 6,939,193 | B1 | * | 9/2005 | McDowell et al. | 446/153 |
| D513,096 | S | * | 12/2005 | Stiles | D21/712 |
| D536,757 | S | * | 2/2007 | Hedeen, Jr. | D21/712 |
| 7,261,432 | B1 | * | 8/2007 | Habitz | 473/570 |
| 7,288,037 | B2 | * | 10/2007 | Myers | 473/613 |
| 2003/0008727 | A1 | * | 1/2003 | Miller | 473/351 |
| 2005/0015032 | A1 | * | 1/2005 | Stein | 601/131 |
| 2005/0064966 | A1 | * | 3/2005 | Menow | 473/569 |
| 2007/0049432 | A1 | * | 3/2007 | Junior et al. | 473/596 |
| 2007/0281811 | A1 | * | 12/2007 | Wang | 473/570 |

* cited by examiner

*Primary Examiner* — Steven Wong
(74) *Attorney, Agent, or Firm* — Jill L. Robinson

(57) ABSTRACT

A game ball is provided with the shape of a football with tubular symmetrically placed holes along the length of the ball. The ball is made of foam and when submerged in water the holes will fill with water. As the ball is thrown in a spiraling rotation, the centrifugal force will cause the water to be expelled through the holes producing multiple spiraling streams of water to spray away from the ball as the ball travels in the air.

5 Claims, 4 Drawing Sheets

FOAM GAME BALL WITH TUBULAR HOLES

BACKGROUND OF THE INVENTION

1. The Field of the Invention

The present invention relates to a solid foam football that has a series of tubular holes that are located along the longitudinal axis of the football, so that when the football is submerged in water and subsequently thrown will allow the water to leave the ball in a spiraling fashion.

2. Description of Related Art

Many different type of footballs have been developed that can be used by sports enthusiasts of all ages and skills. There is a soft foam football under the trademark NERF. The NERF football is soft and easy to throw and catch.

These types of football are made of polyurethane, producing a soft ball. Different variations of the NERF football have been developed. U.S. Pat. No. 5,676,611 describes a foam football that forms an outer shell that surrounds a hollow inner chamber, this helping to create a spiraling motion when thrown. Foam footballs with rearwardly extending fins have also been made which promote a tight spiraling motion have been described in U.S. Pat. No. 4,772,020. U.S. Pat. No. 5,997,422 describes waterproof game balls comprising elastically stretchable panels allow for these balls to be used in and around water.

Producing a football that can be used in the pool or at the lake, river, ocean and will produce a spiral spray when thrown is desirable. The foam type of football is softer and easier to grip than a regular football. It would be desirable to produce a football that is fun to use around the water and produces a special effect spiral spray when submerged and thrown.

BRIEF SUMMARY OF INVENTION

The present invention is an ellipsoid or prolate spheroidally shaped foam ball that is constructed with symmetrically placed tubular holes along the surface of the ball. When the ball is submerged in water the tubular holes will fill with water. These tubular holes will form the paths of least resistance. As the ball is thrown in a forward direction with a spiraling motion the water in the holes and also absorbed by the ball will because of centrifugal force leave the ball producing a spiraling spray. This ball is unique in that can be thrown either wet, producing the spray or can be thrown dry like and of the different foam footballs available.

DESCRIPTION OF THE PREFERRED EMBODIMENT

Figure 1:
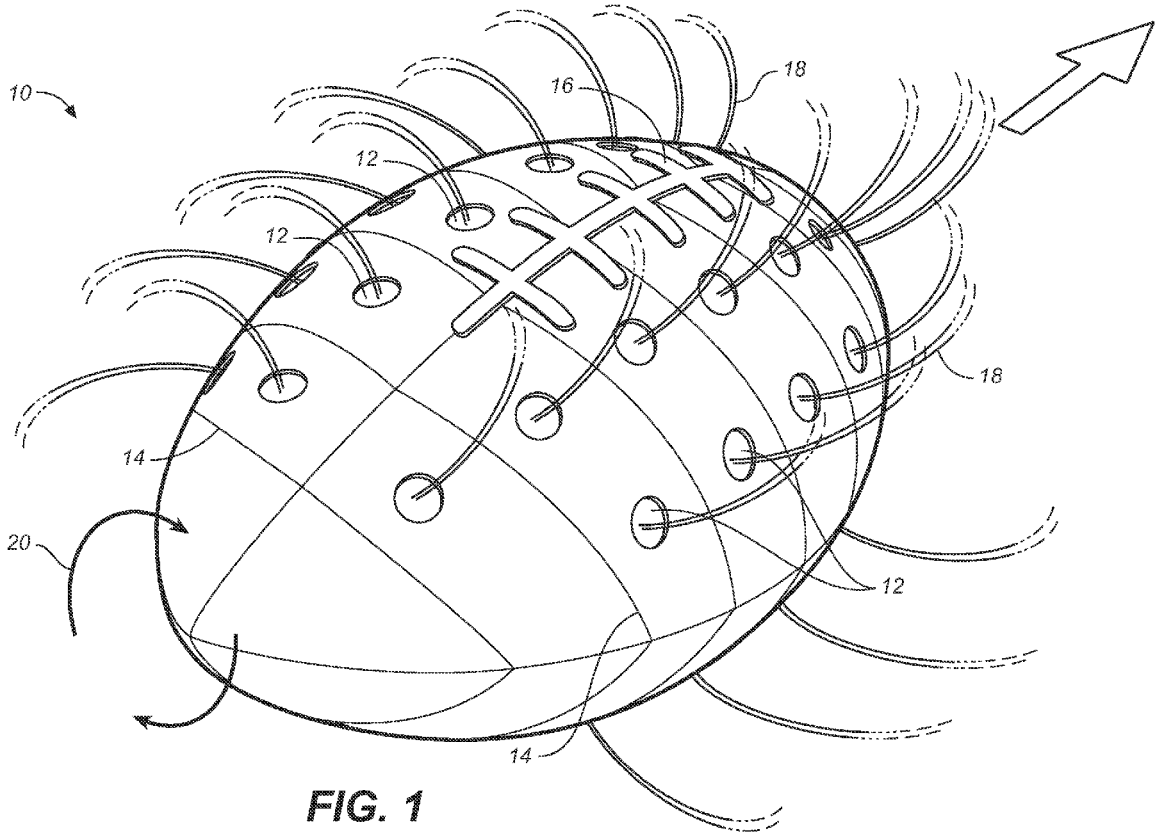
FIG. 1 is a perspective view of the foam football of the present invention.

A football as seen in FIG. 1 is illustrated in accordance with the invention. This figure is an elevated perspective view of the football 10. As seen in FIG. 1 the football 10 is of unitary construction with an ellipsoid ovoid or prolate spheroidal structure. The invention has tubular holes 12 located on the surface of the football 10 that penetrate the football 10 to different depths. These tubular holes 12 when filled with water will expel the water 18 in a spiral fashion 20 when the football 10 is thrown. The tubular holes 12 are located along the longitudinal axis of the football 10 and are directed inwardly toward various points along the central axis of the football. Located from the front of the football 10 to the rear of the football 10 are series of raised ridges that will promote the spiraling 20 of the football 10 when thrown which will cause the water 18 to be expelled from the tubular holes 12 in a spiraling 20 fashion when the football 10 is dunked in water and thrown. Located on the top surface of the football 10 are raised gripping threads 16 which are an extension of the mold and allows the football 10 to be gripped in the usual fashion prior to throwing the football 10 and also aid in the ease of throwing the football 10.

The tubular holes 12 may be constructed so that at least some have only a single opening at the surface of the football 10 from which the water 18 is expelled during flight.

Figure 2:
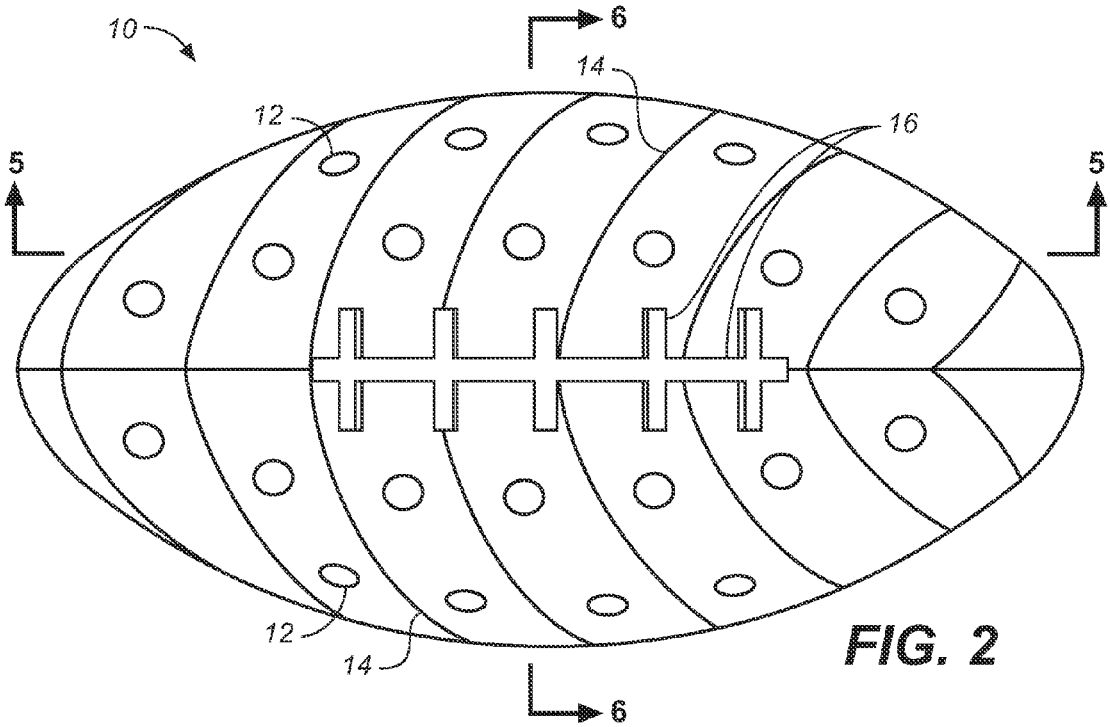
FIG. 2 is a view of the invention from the top

FIG. 2 shows the top surface of the invention. The toy surface shows the tubular holes 12 from which the water 18 is expelled, the raised ridges 14 which also help to produce a spiral when thrown and the raised molded threads 16 which allow for better gripping of the football.

Figure 3:
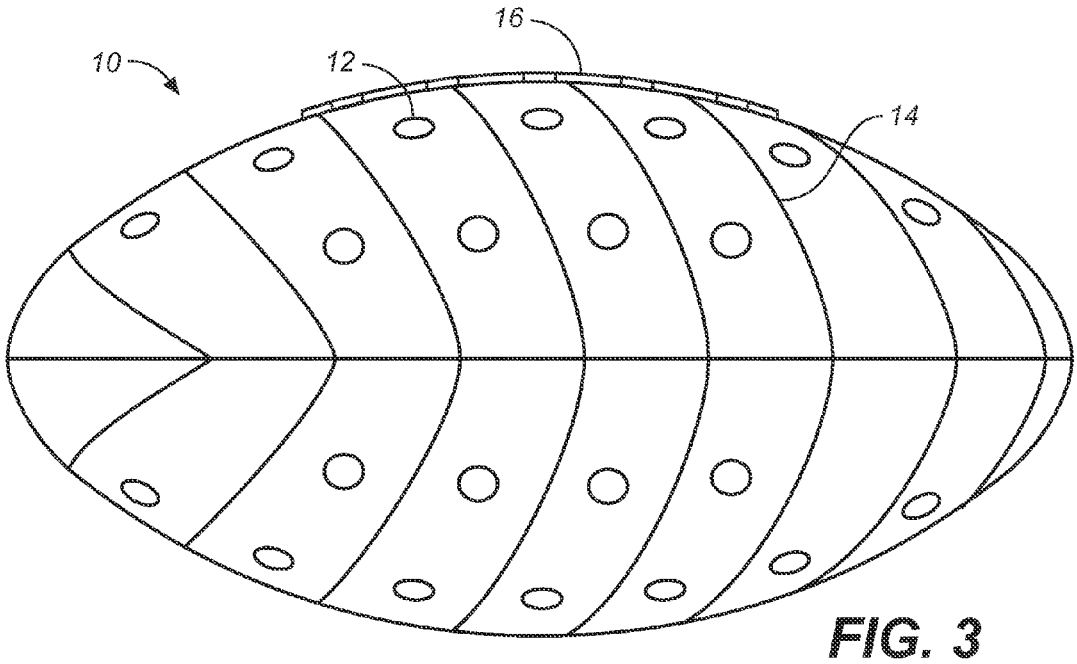
FIG. 3 is a view of the invention from the bottom

FIG. 3 shows the football 10 from the top side along the longitudinal axis with the tubular holes 12, the raised ridges 14 and the raised molded grip threads 16.

Figure 4:
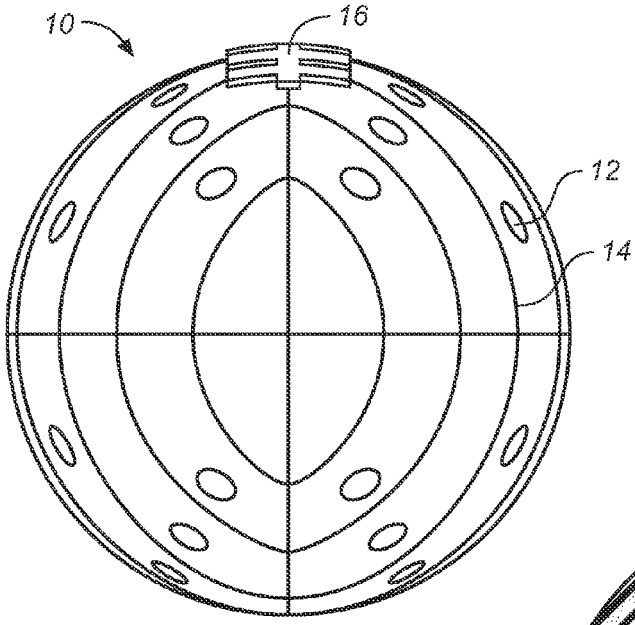
FIG. 4 is a view of the invention from the front or back

FIG. 4 shows the football from the side along the longitudinal axis showing the tubular holes 12, the raised ridges 14 and the raised molded grip threads.

Figure 5:
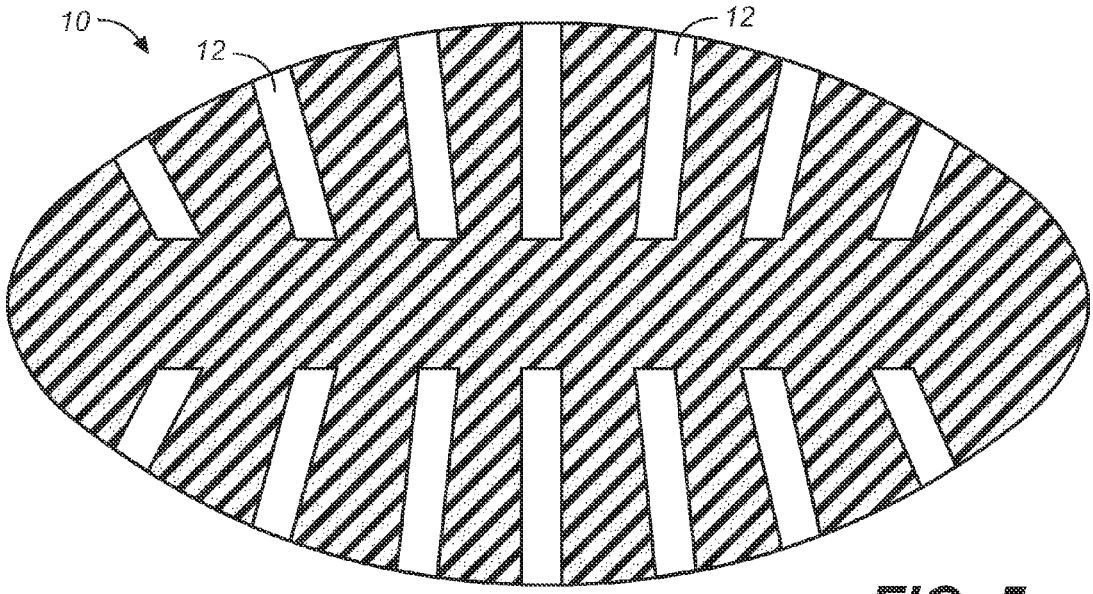
FIG. 5 is a cross sectional view of the invention, splitting the invention along the longitudinal plane

FIG. 5 shows a longitudinal cross section of the football 10 and the tubular holes 12 that penetrate the football to varying lengths.

Figure 6:
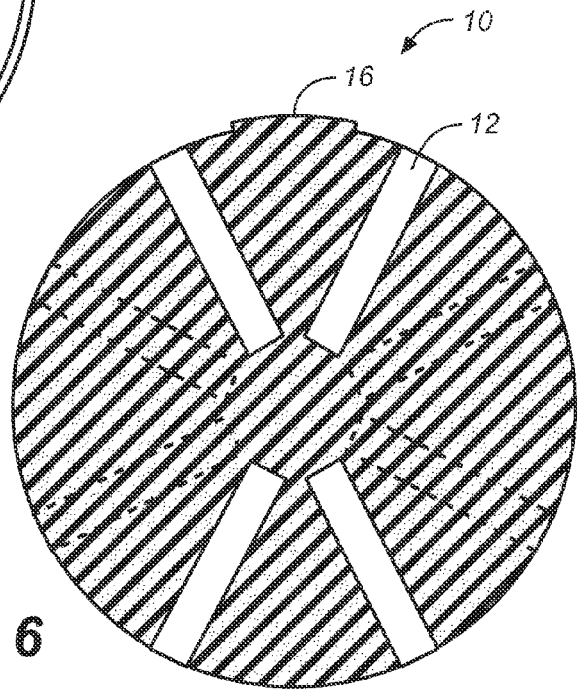
FIG. 6 is a cross sectional view of the invention splitting the invention along the axial plane

FIG. 6 shows an axial cross section of the football 10 taken at a point approximately equidistant between the two ends of the longitudinal axis so that the outer surface of the football 10 at the cross section defines a central circumference around the longitudinal axis, with at least some of the tubular holes 12 lying at or near the central circumference. The tubular holes 12 penetrate the football 10 in a direction toward the center of the football or longitudinal axis to specific depths.

Figure 7:
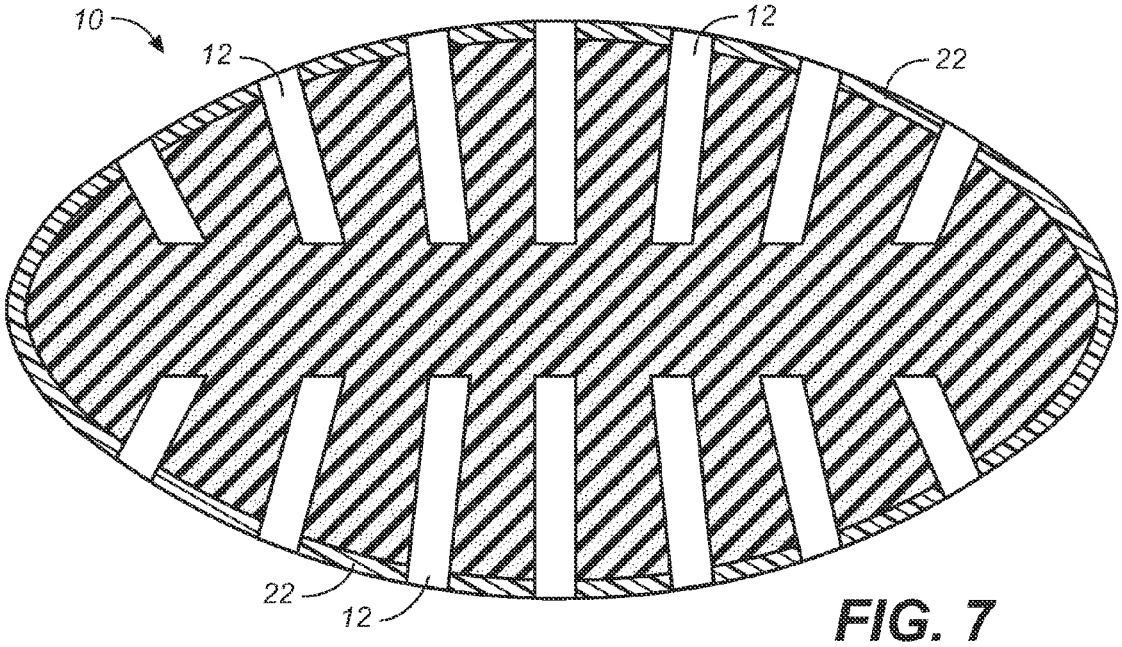
FIG. 7 is a cross sectional view of the invention, splitting the invention along the longitudinal axis, and showing the outer covering

FIG. 7 shows the football 10 in longitudinal cross section again showing the tubular holes 12 of varying depths. The figure also demonstrates a covering 22 that may be placed over the football 10 or may be an connected to the football 10 during the manufacturing process. This covering may contain art or may add protection to the surface of the football 10.

Figure 8:
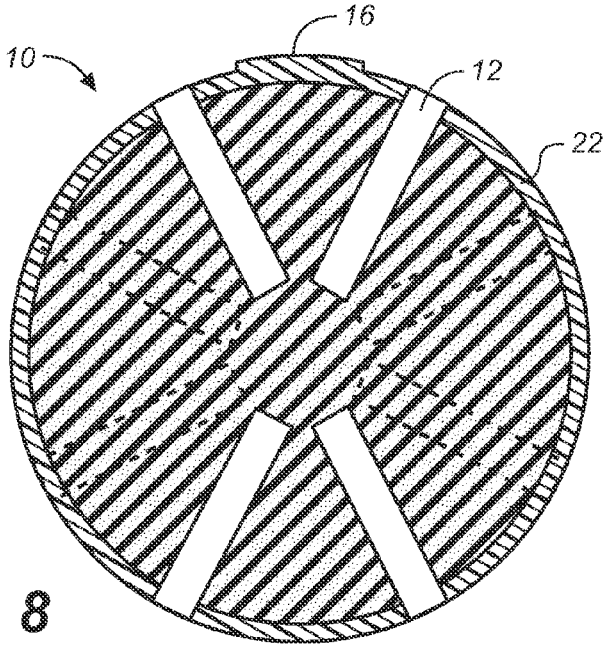
FIG. 8 is a cross sectional view of the invention, splitting the invention along the axial plane, and showing the outer covering.

FIG. 8 is an axial cross section of the football 10 showing the tubular holes 12, the raised molded grip threads and the covering 22 over the football 10.

The invention is preferably made of polyurethane and has a density that is less than water to allow the toy to float in water. The invention may be thrown without first being submerged in water like any football type toy or after submerging the toy in water which will allow the water 18 to be expelled from the tubular holes 12 and spray water 18 in a spiral fashion 20 while the invention is in the air.

From the foregoing description, it can be seen that the present invention comprises an improved foam game ball— football 10. It will be appreciated by those skilled in the art that obvious changes can be made to the embodiment in the foregoing description without departing from the broad inventive concept thereof. The invention may be embodied in other specific forms without departing from the spirit or essential properties. An example of this would be to make the invention in the form of a baseball or volleyball. Another example would be to vary the number of tubular openings 12 or change the size of the tubular openings 12. It is therefore understood that this invention is not limited to a particular embodiment or shape disclosed.

The claims are intended to cover all obvious modifications thereof which are within the scope and the spirit of the invention defined in the claims above.

I claim:

1. A football comprising:

a foam, prolate spheroidal body defining a central axis;

said body defining tubular holes, each said tubular hole consisting of a single opening, wherein a plurality of the tubular holes extend radially inward toward the central axis; and wherein the body is adapted to absorb water, and is adapted to be filled with water and wherein said holes are adapted to project water from the body when the body is filled with water and subsequently thrown.

2. The football of claim 1 wherein the tubular holes are positioned symmetrically on the body.

3. The football of claim 1 further comprising a cover adapted to remain on the football while the football is in use.

4. The football of claim 1 wherein the central axis defines two ends and the football defines a central circumference encircling the central axis, through points approximately equidistant between the two ends of the central axis, and wherein at least one of the tubular holes is positioned to lie close to the central circumference of the football.

5. A football comprising:

a foam, prolate spheroidal body defining a central axis;

said body defining tubular holes, each said tubular hole consisting of a single opening, wherein a plurality of the tubular holes extend radially inward toward the central axis; the central axis defines two ends and the football defines a central circumference encircling the central axis, through points approximately equidistant between the two ends of the central axis, and wherein at least one of the tubular holes is positioned to lie close to the central circumference of the football, and wherein the body is adapted to absorb water, and is adapted to be filled with water and wherein said holes are adapted to project water from the body when the body is filled with water and subsequently thrown.

* * * * *